United States Patent [19]

Sumitomo et al.

[11] Patent Number: 4,851,059

[45] Date of Patent: Jul. 25, 1989

[54] NON-MAGNETIC HIGH HARDNESS AUSTENITIC STAINLESS STEEL

[75] Inventors: Hidehiko Sumitomo, Yamaguchi; Takanori Nakazawa, Kanagawa; Jun Nakatsuka; Jiro Tominaga, both of Yamaguchi; Yoshiaki Kanai, Tokyo, all of Japan

[73] Assignees: Nippon Steel Corp.; TNK Sanwa Precision Co., Ltd., both of Tokyo, Japan

[21] Appl. No.: 165,282

[22] Filed: Mar. 7, 1988

[30] Foreign Application Priority Data

Mar. 12, 1987 [JP] Japan ..... 62-57530
Sep. 17, 1987 [JP] Japan ..... 62-232897

[51] Int. Cl.[4] ..... C22C 38/58

[52] U.S. Cl. ..... 148/327; 420/56; 420/59

[58] Field of Search ..... 420/59, 44, 50, 56; 148/327

[56] References Cited

FOREIGN PATENT DOCUMENTS

| | | | |
|---|---|---|---|
| 60-197853 | 10/1985 | Japan | 420/59 |
| 37953 | 2/1986 | Japan . | |
| 84324 | 4/1986 | Japan . | |
| 163247 | 7/1986 | Japan . | |
| 213351 | 9/1986 | Japan . | |
| 240749 | 10/1987 | Japan . | |

*Primary Examiner*—Deborah Yee
*Attorney, Agent, or Firm*—Wenderoth, Lind & Ponack

[57] ABSTRACT

A non-magnetic cold-deformed stainless steel usable for electronic equipment parts has a Vickers hardness number after cold forming of not less than 400 and a magnetic permeability of not more than 1.01. The steel has excellent hot workability and is mainly used for components such as shafts and pins of VTRs and VTR cassette tapes.

20 Claims, 1 Drawing Sheet

NON-MAGNETIC HIGH HARDNESS AUSTENITIC STAINLESS STEEL

BACKGROUND OF THE INVENTION

1. Field of the Invention

The present invention relates to a high-hardness cold-deformed austenitic stainless steel exhibiting a superior non-magnetic property.

2. Description of the Prior Art

Parts used in electronic equipment which utilize electro-magnetism are required to be non-magnetic. In particular, various kinds of components such as VTR cylinders and capstans, and VTR cassette tape guide rollers and guide pins are required to not only have a non-magnetic property but further, high hardness from the view point of wear resistance is desirable. These parts are also required to have high corrosion resistance and from these points, of view, an austenitic stainless steel is mostly used. In general, austenitic stainless steels, such as Type 305 and Type 316, which have a stable austenitic structure at room temperature are used conventionally.

Although high-hardness austenitic stainless steels in which Manganese is partially substituted for Nickel are disclosed in Japanese Unexamined Patent Publications Nos. 84324/1986 and 213351/1986, the former steel being inferior in hot workability (the term is defined as the workability for the production of steel sheet, strip or wire, etc. by hot-working) and the latter steel being expensive, there has been a strong demand for improvement in this regard. Japanese Unexamined Patent Publication No. 37953/1986 discloses a process for producing a non-magnetic steel, but this publication is silent regarding high hardness and hot workability.

To overcome the problem of inferior hot workability in high-hardness austenitic stainless steels, the present inventors studied the Mn-Ni-Cr austenitic stainless steels. As a result, a stainless steel was developed which exhibits good hot workability, high corrosion resistance, high hardness and is non-magnetic after cold forming. This stainless steel is very useful for parts of electronic equipment and is especially suitable for use in various kinds of shafts for VTRs and VTR cassette tapes.

SUMMARY OF THE INVENTION

An object of the present invention is to provide a non-magnetic, high-hardness cold-deformed austenitic stainless steel exhibiting excellent hot workability and other superior properties. For attaining this object the present inventors studied austenitic stainless steels of various chemical compositions. As a result, a non-magnetic stainless steel usable for electronic equipment parts was discovered which comprises, by weight, 0.1 to 0.3% of carbon (C), 0.1 to 2% of silicon (Si), 8 to 15% of manganese (Mn), not more than 0.006% of sulfur (S), 3 to 8% of nickel (Ni), 18 to 22% of chromium (Cr), not more than 0.01% of oxygen (O), 0.1 to 0.5% of nitrogen (N), 0.0001 to 0.02% of calcium (Ca) and the balance substantially iron (Fe) and incidental impurities, meeting the conditions of Nieq≧18 wt % and Creq ≦23 wt %, wherein the Vickers hardness number after cold forming thereof is not less than 400, where $$Nieq = Ni\% + 30C\% + 25N\% + 0.5Mn\ \% \quad (1)$$

$$Creq = Cr\% + 1.5Si\% \quad (2)$$

The steel material of the present invention is a hot-rolled steel, and can be rolled or formed in various shapes such as strip, sheet, wire, bar and pipe. Various components such as VTR cylinders and capstans and VTR cassette tape guide rollers and guide pins can be formed from the material of this invention. In the case of a strip or sheet, the steel is deformed into a tube or pipe by a reducing mill or a pressing mill and, depending on the intended use thereof, is further deformed by a cold-drawing mill.

DESCRIPTION OF THE PREFERRED EMBODIMENTS

Figure 1:
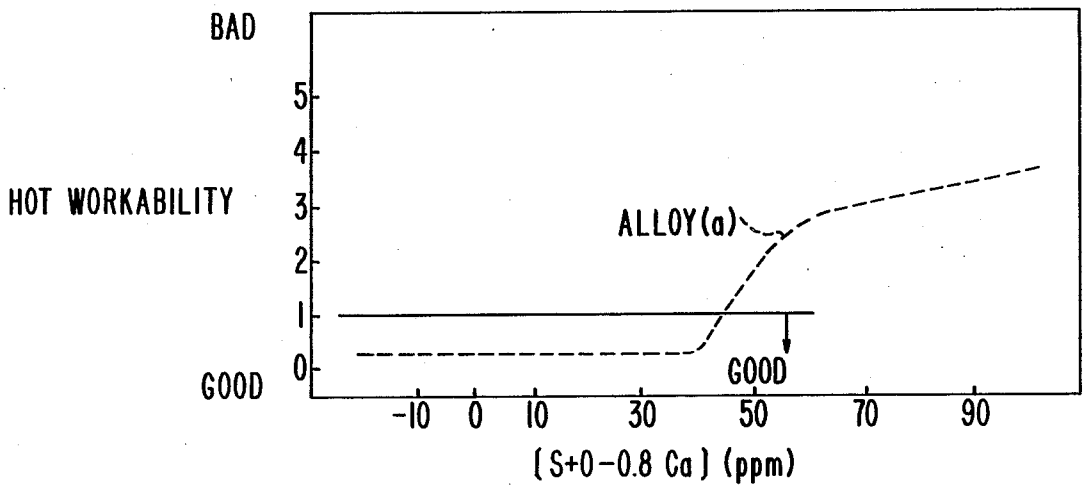
FIG. 1 shows a conventional relationship between chemical compositions and hot workability of a high alloy stainless steel.

An explanation will be given hereunder as to the reasons for the limitations on the contents (given in weight percent) of the respective elements.

Carbon is an austenite stabilizer and also contributes to hardness. For obtaining these effects, the C content should not be less than 0.1%. However, a C content in excess of 0.3% results in carbide precipitates at the grain boundaries which impairs corrosion resistance, a property which is required for electronic equipment parts. Therefore, the carbon content is limited to between 0.1 and 0.3%, preferably between 0.15 and 0.20%.

Silicon is an element which improves work-hardenability. However, a Si content of less than 0.1% is insufficient for producing this effect. Due to the fact that silicon also works as a ferrite stabilizer, when the Si content exceeds 2%, the steel becomes a ferrite-austenite dual phase steel, and this increases the magnetic permeability of the steel. For these reasons, silicon content is limited to be between 0.1 and 2%. The silicon content is preferably between 0.1 and 1.0%.

Manganese is an inexpensive austenite stabilizer and it also is needed for obtaining the non-magnetic property. A non-magnetic property sufficient for electronic equipment parts is not obtained when the manganese content is less than 8%, but the effect becomes saturated when Mn exceeds 15%. For these reasons, manganese content is limited to be 8 to 15%, preferably 9 to 10%.

Sulfur is effective in preventing hot workability when S exceeds 0.006%. Sulfur content is therefore limited to not more than 0.006%, and preferably does not exceed 0.003%.

Nickel is a strong austenite stabilizer, and when the content thereof is less than 3% the non-magnetic property cannot be obtained. However, when Ni exceeds 8%, the steel becomes over-stabilized and expensive. Thus, the nickel content is limited to 3 to 8%. Preferably, the nickel content is selected to fall between 5 and 6%.

Chromium in an amount less than 18% is not sufficient to provide the desired corrosion resistance required for electronic equipment parts and when Cr exceeds 22%, the steel becomes a ferrite-austenite dual phase steel with increased magnetic permeability. For these reasons, the chromium content is limited to 18 to 22%, preferably 20 to 22%.

Oxygen is likely to prevent hot workability when O exceeds 0.01%. Thus, oxygen content is limited to not more than 0.01%.

Nitrogen also works as an austenite stabilizer like carbon, and also contributes to solution hardening. This effect is insufficient for electronic equipment parts when the N content is less than 0.1%, but the addition of over 0.5% of nitrogen is undesirable because blowholes will likely be formed in the ingot. For these reasons, the nitrogen content is selected to be in the range of between 0.1 and 0.5%. Preferably, the nitrogen content is between 0.25 and 0.35%.

Calcium is an element which improves hot workability but its effect is insufficient when added in amounts of less than 0.0001%. However, when the Ca content exceeds 0.02% the effect saturates, and this is also undesirable in view of cost. Therefore, the calcium content is limited to between 0.0001 to 0.02%.

Nieq is an index which indicates the austenitic stability. When the Nieq value is less than 18, the magnetic permeability of the steel after cold forming exceeds 1.01, and the desired non-magnetic property is not obtained. Thus, Nieq is limited to not less than 18.

Creq is an index which indicates the ferritic stability. When the Creq value exceeds 23, the steel becomes a ferrite-austenite dual phase steel, and magnetic permeability increases. For this reason, Creq is limited to not more than 23.

In accordance with another aspect of invention, a PV value is defined as:

$$PV = S(ppm) + O(ppm) - 0.8Ca\ (ppm) - 30 \quad (3)$$

The PV value is an index which indicates hot workability and if this index exceeds 0, the material breaks during hot rolling. For this reason, the maximum value for PV is limited to not more than 0.

The idea of the relationship of the PV value and hot workability is explained in Japanese Unexamined Patent Publication No. 163247/1986. This publication discloses a high alloy stainless steel exhibiting superior corrosion resistance and hot workability. According to the description therein, the most effective elements relating to the hot workability of high alloy steel slabs are sulfur, oxygen, and calcium, and these elements have an effect on hot workability with the condition of:

$$S(ppm) + O(ppm) - 0.8Ca\ (ppm)$$

Then the specification of this publication explains the relationship of high alloy stainless steel (a), 21Cr−18Ni−0.3N−6Mo and hot workability which is shown in FIG. 1. From the figure, the hot workability is excellent when:

$$S(ppm) + O(ppm) - 0.8Ca\ (ppm) \leqq 40$$

The PV condition of the present invention is restricted more strictly as shown in equation (3), because the materials are required to have more superior hot workability than the steel disclosed in the above-mentioned publication.

When Nieq and Creq are within the aforesaid limits, the hot workability is developed and productivity is greatly improved.

Hardness is indicated by Vickers hardness number, and if this number is less than 400, the guide roller, etc. produced from the steel and used in VTR cassette tapes and so forth will wear over a long period of use and scratch the tape. Hardness is also desirable for avoiding dimples or scratches on the surface of parts in automatic assembly lines used for making electronic equipment.

In accordance with some uses requiring greater wear resistance, the Vickers hardness number is preferably limited to not less than 450.

When the magnetic permeability of a part exceeds 1.01, it is likely to affect any ambient magnetic field. Thus, in accordance with another aspect of the invention, the permeability is limited to not more than 1.01.

Each austenitic stainless steel shown in Table 1 was subjected to either hot-rolling and then cold-rolling for forming a sheet or strip or, hot-rolling and was thereafter cold-deformed into a wire, bar or pipe. The sheet was further formed into a pipe by deep drawing. These materials were tested for hot workability, hardness, magnetic permeability and corrosion resistance with the results shown in Table 2. An X in the hot workability column indicates cracking during hot-rolling, while a ○ indicates that no cracking occurred. Hardness is expressed by Vickers number as measured on the 50% cold-rolled materials by the method of JIS (Japan Industrial Standard) Z2244 (Method of Vickers Hardness Test). Magnetic permeability is measured on the same materials. Corrosion resistance was measured by the salt spray testing method of JIS Z2371. In the corrosion resistance column of Table 2, X indicates the occurrence of staining, while ○ means that no staining occurred. It is seen that all of the steels according to the present invention were superior to conventional steels from the viewpoint of hot workability and corrosion resistance and further, the inventive steels had very high hardness and low magnetic permeability.

Examples of parts made from the inventive steels are described as follows:

(1) Pipe for VTR cassette tape guide rollers made from the steel material set forth in sample E.

(a) A 0.6 mm thick cold-rolled sheet was annealed at 1150° C. in air, pickled, and then deep-drawn into a 6 mm diameter pipe (reduction ratio: 60%). The Vickers hardness number thereof was 450, and magnetic permeability was 1.004.

(b) The same cold-rolled material as in (a.) was bright-annealed at 1150° C., seam-welded into pipe, and then cold-drawn into a 6 mm diameter pipe. The Vickers hardness number thereof was 480, and magnetic permeability was 1.004.

(2) Pin for VTR cassette tape guide pins made from the steel material set forth in sample E.

A hot-rolled 7 mm diameter wire rod was annealed at 1150° C. in air, pickled, and then drawn into a 2.7 mm diameter pin (reduction ratio: 85%). The Vickers hardness number thereof was 500, and magnetic permeability was 1.004.

As will be understood from the foregoing description, the invention provides a non-magnetic stainless steel which exhibits excellent hot formability and is therefore well suited for use in electronic equipment parts. It thus greatly contributes to improvements in the field of industry concerned.

While the present invention has been described with reference to the foregoing embodiments, it will be understood by those skilled in the art that various changes and modifications may be made thereto which fall within the scope of the appended claims.

TABLE 1

| | Sample | Chemical Compositions (wt %) C | Si | Mn | S | Ni | Cr | 0 | N | Ca | Calculated Values Nieq | Creq | PV |
|---|---|---|---|---|---|---|---|---|---|---|---|---|---|
| STEELS OF THE INVENTION | A | 0.11 | 0.52 | 8.4 | 0.002 | 5.8 | 20.0 | 0.003 | 0.45 | 0.0036 | 24.6 | 20.8 | −8.8 |
| | B | 0.21 | 0.55 | 9.8 | 0.001 | 6.1 | 20.2 | 0.001 | 0.29 | 0.0005 | 24.6 | 21.0 | −14.0 |
| | C | 0.28 | 0.30 | 10.3 | 0.006 | 7.6 | 22.0 | 0.008 | 0.15 | 0.0157 | 24.9 | 22.5 | −15.6 |
| | D | 0.20 | 1.80 | 14.6 | 0.004 | 3.6 | 18.0 | 0.003 | 0.10 | 0.0055 | 19.4 | 20.7 | −4.0 |
| | E | 0.17 | 0.55 | 9.5 | 0.001 | 5.4 | 21.0 | 0.003 | 0.30 | 0.0035 | 22.8 | 21.8 | −18.0 |
| COMPARISON STEELS | F | 0.04 | 0.45 | 0.58 | 0.003 | 10.6 | 18.2 | 0.002 | 0.02 | 0.0020 | 12.6 | 18.9 | 4.0 |
| | G | 0.60 | 0.50 | 0.80 | 0.006 | 10.0 | 12.0 | 0.003 | 0.03 | 0.0030 | 29.2 | 12.8 | 36.0 |
| | H | 0.10 | 0.20 | 0.61 | 0.001 | 12.0 | 23.5 | 0.011 | 0.20 | 0.0108 | 20.3 | 23.8 | 3.6 |

TABLE 2

| | Sample | Hot Workability | Hardness after 50% Cold-Rolling Hv | Magnetic Permeability After Cold-Rolling μ | Corrssion Resistance |
|---|---|---|---|---|---|
| STEELS OF THE INVENTION | A | ○ | 400 | 1.003 | ○ |
| | B | ○ | 420 | 1.004 | ○ |
| | C | ○ | 450 | 1.003 | ○ |
| | D | ○ | 475 | 1.004 | ○ |
| | E | ○ | 415 | 1.004 | ○ |
| COMPARISON STEELS | F | X | 350 | 1.025 | ○ |
| | G | X | 480 | 1.003 | X |
| | H | X | 370 | 1.015 | ○ |

(the steels of Table 1 were heated to 1260° C. prior to hot rolling and the total reduction was 94%)

What is claimed is:

1. A non-magnetic cold-deformed stainless steel usable for electronic equipment parts consisting essentially of, by weight, 0.1 to 0.3% of carbon (C), 0.1 to 2% of silicon (Si), 8 to 15% of manganese (Mn), not more than 0.006% of sulfur (S), 3 to 8% of nickel (Ni), 20 to 22% of Chromium (Cr), not more than 0.01% of oxygen (O), 0.1 to 0.5% of nitrogen (N), 0.0001 to 0.02% of calcium (Ca) and the balance substantially iron (Fe) and incidental impurities, meeting the conditions of Nieq≧18 wt %, Creq≦23 wt %, wherein the Vickers hardness number after cold forming thereof is not less than 400 and where:

$$Nieq = Ni\% + 30C\% + 25N\% + 0.5Mn\ \%$$

$$Creq = Cr\% + 1.5\ Si\ \%.$$

2. A non-magnetic cold-deformed stainless steel usable for electronic equipment parts according to claim 1, wherein the Vickers hardness number after cold forming thereof is not less than 450.

3. A non-magnetic cold-deformed stainless steel usable for electronic equipment parts according to claim 1, wherein the PV value thereof defined as $$PV = S(ppm) + O(ppm) - 0.8Ca(ppm) - 30$$

is not more than 0.

4. A non-magnetic cold-deformed stainless steel usable for electronic equipment parts according to claim 1, wherein the Vickers hardness number after cold forming thereof is not less than 450 and the PV value thereof defined as $$PV = S(ppm) + O(ppm) - 0.8Ca(ppm) - 30$$

is not more than 0.

5. A non-magnetic cold-deformed stainless steel usable for electronic equipment parts according to claim 1, wherein the magnetic permeability thereof is not more than 1.01.

6. A non-magnetic cold-deformed stainless steel usable for electronic equipment parts consisting essentially of, by weight, 0.15 to 0.2% of carbon (C), 0.1 to 1% of silicon (Si), 9 to 10% of manganese (Mn), not more than 0.003% of sulfur (S), 5 to 6% of nickel (Ni), 20 to 22% of chromium (Cr), not more than 0.01% of oxygen (O), 0.25 to 0.35% of nitrogen (N), 0.0001 to 0.02% of calcium (Ca) and the balance substantially iron (Fe) and incidental impurities, meeting the conditions of Nieq≧18 wt %, Creq≦23 wt %, PV value≦0, the Vickers hardness number after cold forming thereof is not less than 400, and the magnetic permeability is not more than 1.01, where:

$$Nieq = Ni\ \% + 30C\ \% + 25N\ \% + 0.5Mn\ \%$$

$$Creq = Cr\ \% + 1.5\ Si\ \%$$

$$PV = S(ppm) + O(ppm) - 0.8Ca(ppm) - 30.$$

7. An electronic equipment part made of the steel according to claim 1.

8. An electronic equipment part of the steel according to claim 6.

9. A shaft useful in a VTR or a VTR cassette tape which is made of the steel according to claim 1.

10. A shaft useful in a VTR or a VTR cassette tape which is made of the steel according to claim 6.

11. A pin useful in a VTR or a VTR cassette tape which is made of the steel according to claim 1.

12. A pin useful in a VTR or a VTR cassette tape which is made of the steel according to claim 6.

13. A non-magnetic cold-deformed austenitic steel usable for electronic equipment parts comprising, by weight, 0.1 to 0.3% C, 0.1 to 2% Si/ 8 to 15% Mn, not more than 0.006% S, 3 to 8% Ni, 18to 22% Cr, not more than 0.01% O, 0.1 to 0.5% N, 0.0001 to 0.02% Ca and the balance substantially Fe, said step a Vickers hardness number after cold forming thereof of not less than 400, $Ni_{eq} \geqq 18$ wt. % and $Cr_{eq} \leqq 23$ wt. %, wherein:

$$Ni_{eq} = Ni\ \% + 30C\ \% + 25N\ \% \text{ to } 0.5\ Mn\ \% \text{ and}$$

$$Cr_{eq} = Cr\ \% + 1.5Si\ \%.$$

14. The steel of claim 13, wherein said Vickers hardness number after cold forming thereof is not less than 450 and Cr is in the range of 20 to 22%.

15. The steel of claim 13, wherein said steel has a PV valve of not more than 0, wherein:

$$PV = S(ppm) + O(ppm) - 0.8Ca(ppm) - 30.$$

16. The steel of claim 14, wherein said steel has a PV valve of not more than 0, wherein:

$$PV = S(ppm) + O(ppm) - 0.8Ca(ppm) - 30.$$

17. The steel of claim 13, wherein said steel has a magnetic permeability of not more than 1.01.

18. The steel of claim 13, wherein said steel comprises a part of an electronic piece of equipment.

19. The steel of claim 13, wherein said steel comprises a shaft of a VTR or VTR cassette tape.

20. The steel of claim 13, wherein said steel comprises a pin of a VTR or VTR cassette tape.

* * * * *